United States Patent [19]

Alvarez

[11] Patent Number: 4,849,610

[45] Date of Patent: Jul. 18, 1989

[54] TOWEL WARMER

[76] Inventor: Moises Alvarez, 811 Sip St., Union City, N.J. 07087

[21] Appl. No.: 200,717

[22] Filed: May 31, 1988

[51] Int. Cl.[4] ..... F24C 15/32

[52] U.S. Cl. ..... 219/521; 219/400; 219/385

[58] Field of Search ..... 219/521, 385, 386, 400, 219/214; 34/195, 196, 197, 202, 215, 224, 225, 232, 233; 126/21 A, 21 R

[56] References Cited

U.S. PATENT DOCUMENTS

| | | | |
|---|---|---|---|
| 2,479,706 | 8/1949 | Williams | 34/233 |
| 3,073,039 | 1/1963 | Williams | 34/233 |
| 3,239,949 | 3/1966 | Miles | 219/386 |
| 3,324,844 | 6/1967 | Huffman | 219/400 |
| 3,839,622 | 10/1974 | Mastin | 126/21 A |
| 3,905,760 | 9/1975 | Johansson | 219/400 |
| 4,224,743 | 9/1980 | Erickson | 126/21 A |
| 4,295,419 | 10/1981 | Langhammer | 219/400 |
| 4,512,327 | 4/1985 | Stiegler | 126/21 A |
| 4,559,442 | 12/1985 | Graham | 219/385 |
| 4,559,903 | 12/1985 | Bloom | 219/400 |

FOREIGN PATENT DOCUMENTS

| | | | |
|---|---|---|---|
| 2015137 | 9/1979 | United Kingdom | 219/400 |
| 2131259 | 6/1984 | United Kingdom | 219/400 |

*Primary Examiner*—Teresa J. Walberg

*Attorney, Agent, or Firm*—Howard M. Schwinger

[57] ABSTRACT

A towel warming cabinet having a large central chamber in communication with the exterior when the door is opened, the marginal portion of the cabinet being closed off from the exterior when the cabinet is mounted to provide stowage space for components, a plurality of spaced towel racks extending into the central chamber from the rear wall thereof, heating elements disposed on either side of the central chamber within the stowage space, a perforated screen shielding the central chamber from the heating elements, circuitry disposed in the stowage space for electrically connecting the components to a power source.

1 Claim, 1 Drawing Sheet

TOWEL WARMER

This invention relates to a towel warmer and more particularly to a cabinet for warming towels.

OBJECTS OF THE INVENTION

While heretofore various proposals have been set forth for warming towels, such have been deficient in one respect or another and thus a really successful device of this nature has yet to be provided.

It is thus a primary object of the present invention to provide an efficient towel warming apparatus.

It is yet another important object of the present invention to provide a towel warming apparatus which will blend with conventional bathroom decor.

It is still a further object of the present invention to provide a towel warming apparatus which is inexpensive to make and simple to operate It is a further object of the present invention to provide a towel warming apparatus which presents no fire or electrical hazards.

These and other objects will be realized with a towel warmer comprising a cabinet having a large central chamber in communication with the exterior, the marginal portion of the cabinet being closed off from the exterior when the cabinet is mounted to provide space for components, a plurality of spaced towel racks extending into the central chamber from the rear wall thereof, heating elements disposed on either side of the central chamber within the space for components, the side walls of the central chamber shielding the central chamber from the heating elements, said side walls being perforated to permit heat to pass therethrough, fans disposed in the space for components for circulating heated air within the cabinet, circuitry disposed in the component space for electrically connecting the components to a power source.

Other objects and advantages of the present invention will become apparent from a reading of the following specification taken in connection with the accompanying drawing wherein:

DETAILED DESCRIPTION OF THE VIEWS OF THE DRAWING

Figure 1:
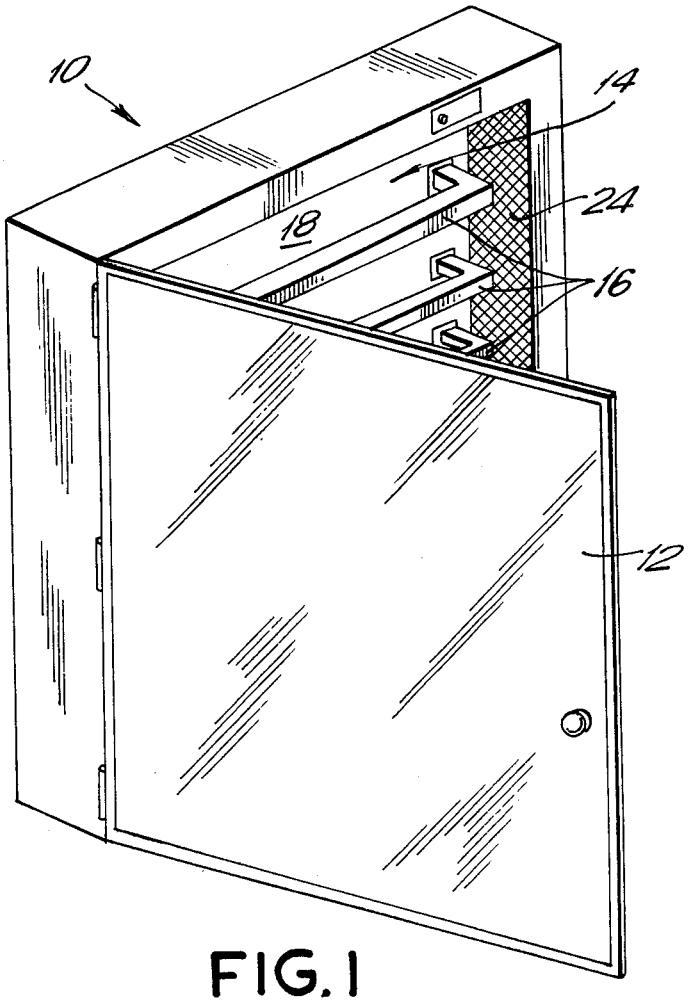
FIG. 1 is a perspective view of one embodiment of the present invention.
Figure 2:
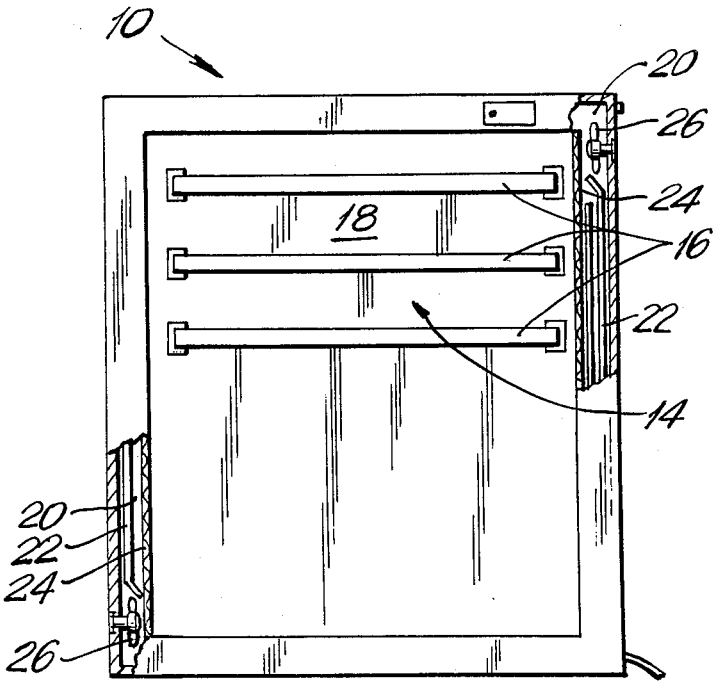
FIG. 2 is a front elevation of the device of FIG. 1 with certain elements removed.

A towel warming cabinet in accordance with the present invention is shown in FIG. 1 consisting of a metal cabinet 10 having a mirrored door 12 hingedly connected thereto closing off a large central chamber 14 from the exterior when closed. Towel racks 16 extend from the rear wall 18 of the cabinet into chamber 14.

The cabinet is provided with a narrow marginal chamber 20 which surrounds central chamber 14 on all sides. Access to the marginal chamber can be had from the rear of the cabinet before the cabinet is mounted. It is intended that the cabinet be wall mounted. It is also intended that components and circuitry be disposed in marginal chamber 20.

Heating elements 22 are provided on either side of central chamber 14 within marginal chamber 20. A perforated wall 24 separates the central chamber from the marginal chamber so heat can radiate into the central chamber to warm towels hanging on racks 16. Fans 26 are provided in the marginal chamber for circulating heated air throughout the cabinet.

Circuitry such as wiring, electrical connections, timers, switches and the like are housed in marginal chamber 20.

It should be realized that the embodiment herein described is only representative of the invention and it is not intended to limit the invention to one particular embodiment as the invention encompasses all embodiments falling with the spirit and scope of the appended claims.

I claim:

1. A towel warming cabinet comprising a cabinet having a door hingedly connected thereto, said cabinet having a large central chamber in communication with the exterior when the door is opened, a marginal portion of the cabinet being closed off from the exterior only when the cabinet is wall mounted to provide a space for components, said marginal portion completely encircling the central chamber, a plurality of spaced towel racks extending into the central chamber from a rear wall thereof, heating elements disposed on either side of the central chamber within the space for components, a perforated screen shielding the central chamber from the heating elements, oppositely disposed laterally directed fans in the space for components for forcing heated air into the central chamber, circuitry disposed in the space for components for electrically connecting the components to a power source.

* * * * *